US012607080B2

(12) United States Patent
Mueller et al.

(10) Patent No.: US 12,607,080 B2
(45) Date of Patent: Apr. 21, 2026

(54) SYSTEMS AND METHODS FOR AUTONOMOUS WELL INTERVENTION

(71) Applicant: Schlumberger Technology Corporation, Sugar Land, TX (US)

(72) Inventors: Andrew Mueller, Sugar Land, TX (US); Todor K. Sheiretov, Sugar Land, TX (US); Luis Silva, Sugar Land, TX (US); David Engel, Larose, LA (US); Kamalah Chang, Taubate (BR); Fabio Jose Pestana, Taubate (BR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/649,469

(22) Filed: Apr. 29, 2024

(65) Prior Publication Data

US 2025/0334009 A1 Oct. 30, 2025

(51) Int. Cl.

| | |
|---|---|
| ***E21B 23/00*** | (2006.01) |
| ***E21B 41/00*** | (2006.01) |
| *E21B 37/00* | (2006.01) |
| *E21B 41/04* | (2006.01) |
| *E21B 43/12* | (2006.01) |
| *E21B 47/12* | (2012.01) |

(52) U.S. Cl.

CPC ..... *E21B 23/001* (2020.05); *E21B 41/0007* (2013.01); *E21B 37/00* (2013.01); *E21B 41/04* (2013.01); *E21B 43/123* (2013.01); *E21B 47/12* (2013.01)

(58) Field of Classification Search

CPC ..... E21B 23/001; E21B 34/142; E21B 41/04; E21B 43/123; E21B 47/12

See application file for complete search history.

(56) References Cited

U.S. PATENT DOCUMENTS 6,378,627 B1 * 4/2002 Tubel ..... E21B 17/1078 166/255.2
6,454,011 B1 * 9/2002 Schempf ..... E21B 19/143 166/70

(Continued)

FOREIGN PATENT DOCUMENTS

AU 777154 A1 2/2002
EP 2407631 A1 1/2012

(Continued)

OTHER PUBLICATIONS

Fox and Long, "PDDL2.1: An Extension to PDDL for Expressing Temporal Planning Domains", Journal of Artificial Intelligence Research, 20 (2003) pp. 61-124.

(Continued)

*Primary Examiner* — Matthew R Buck
(74) *Attorney, Agent, or Firm* — Jeffrey D. Frantz

(57) ABSTRACT

A system includes an autonomous robotic system and a docking system deployed by a seaborne vessel. The docking system houses the autonomous robotic system and couples to a subsea structure of a subsea system. The subsea structure is disposed on a sea floor. The autonomous robotic system deploys from the docking system into a wellbore of a subsea well of the subsea system. The autonomous robotic system also moves within the wellbore.

20 Claims, 8 Drawing Sheets

(56) References Cited

U.S. PATENT DOCUMENTS

| | | | | |
|---|---|---|---|---|
| 6,808,021 | B2 * | 10/2004 | Zimmerman | B63G 8/001 166/341 |
| 6,845,819 | B2 * | 1/2005 | Barrett | E21B 17/028 166/250.01 |
| 8,171,989 | B2 * | 5/2012 | Goode | E21B 47/12 166/250.01 |
| 8,322,447 | B2 | 12/2012 | Loretz | |
| 9,109,419 | B2 | 8/2015 | Fenton | |
| 9,145,761 | B2 * | 9/2015 | Hallundbæk | E21B 33/076 |
| 10,030,505 | B1 | 7/2018 | Toniolo | |
| 2002/0096322 | A1 | 7/2002 | Barrett et al. | |
| 2009/0140604 | A1 | 6/2009 | Chen | |
| 2011/0240303 | A1 * | 10/2011 | Hallundbaek | B63G 8/001 166/339 |
| 2015/0293258 | A1 | 10/2015 | Kamal et al. | |
| 2017/0299758 | A1 | 10/2017 | Pelletier et al. | |
| 2018/0209236 | A1 | 7/2018 | Talgø | |
| 2019/0031307 | A1 * | 1/2019 | Siersdorfer | E21B 41/0007 |
| 2019/0368331 | A1 | 12/2019 | Vick, Jr. | |
| 2020/0165890 | A1 * | 5/2020 | Homero Thome Ferreira | E21B 23/00 |
| 2022/0205328 | A1 | 6/2022 | Fanini et al. | |
| 2024/0279993 | A1 * | 8/2024 | Fripp | B60L 53/50 |
| 2024/0344431 | A1 * | 10/2024 | Gupta | E21B 41/04 |

FOREIGN PATENT DOCUMENTS

| | | | |
|---|---|---|---|
| WO | 2021046366 | A1 | 3/2021 |
| WO | 2023187458 | A1 | 10/2023 |
| WO | 2024030364 | A1 | 2/2024 |

OTHER PUBLICATIONS

Leonetti et al., "A synthesis of automated planning and reinforcement learning for efficient, robust decision-making", Aritificial Intelligence, vol. 241, Dec. 2016, pp. 103-130.

Search Report and Written Opinion of International Patent Application No. PCT/US2023/029091 on Nov. 20, 2023; 11 pages.

* cited by examiner

SYSTEMS AND METHODS FOR AUTONOMOUS WELL INTERVENTION

BACKGROUND

The present disclosure generally relates to systems and methods for subsea well intervention using an autonomous robotic system.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it may be understood that these statements are to be read in this light, and not as admissions of prior art.

Producing from a well, particularly from a subsea well, is a remarkably complex endeavor. One method for performing subsea well interventions may be deployed by slickline and/or electric line. However, the use of slicklines and/or electric lines may call for a seaborne vessel or platform to remain afloat at a location substantially above the subsea well for an extended period of time. The cost of operating the vessel greatly increases the longer the vessel remains onsite.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a system includes an autonomous robotic system and a docking system deployed by a seaborne vessel. The docking system houses the autonomous robotic system and couples to a subsea structure of a subsea system. The subsea structure is disposed on a sea floor. The autonomous robotic system deploys from the docking system into a wellbore of a subsea well of the subsea system. The autonomous robotic system also moves within the wellbore.

In another embodiment, a system includes an autonomous robotic system. The autonomous robotic system deploys from a docking system into a wellbore of a subsea well of a subsea system. The wellbore disposed in a sea floor. The autonomous robotic system also moves within the wellbore.

In another embodiment, a method includes deploying, via a seaborne vessel, a first docking system to a first subsea structure of a first subsea system. The method also includes deploying a first autonomous robotic system from the first docking system into a first wellbore of the first subsea system. The method also includes performing, via the first autonomous robotic system, a first operation on the first well while concurrently deploying, via the seaborne vessel, a second docking system to a second subsea structure of a second subsea system.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
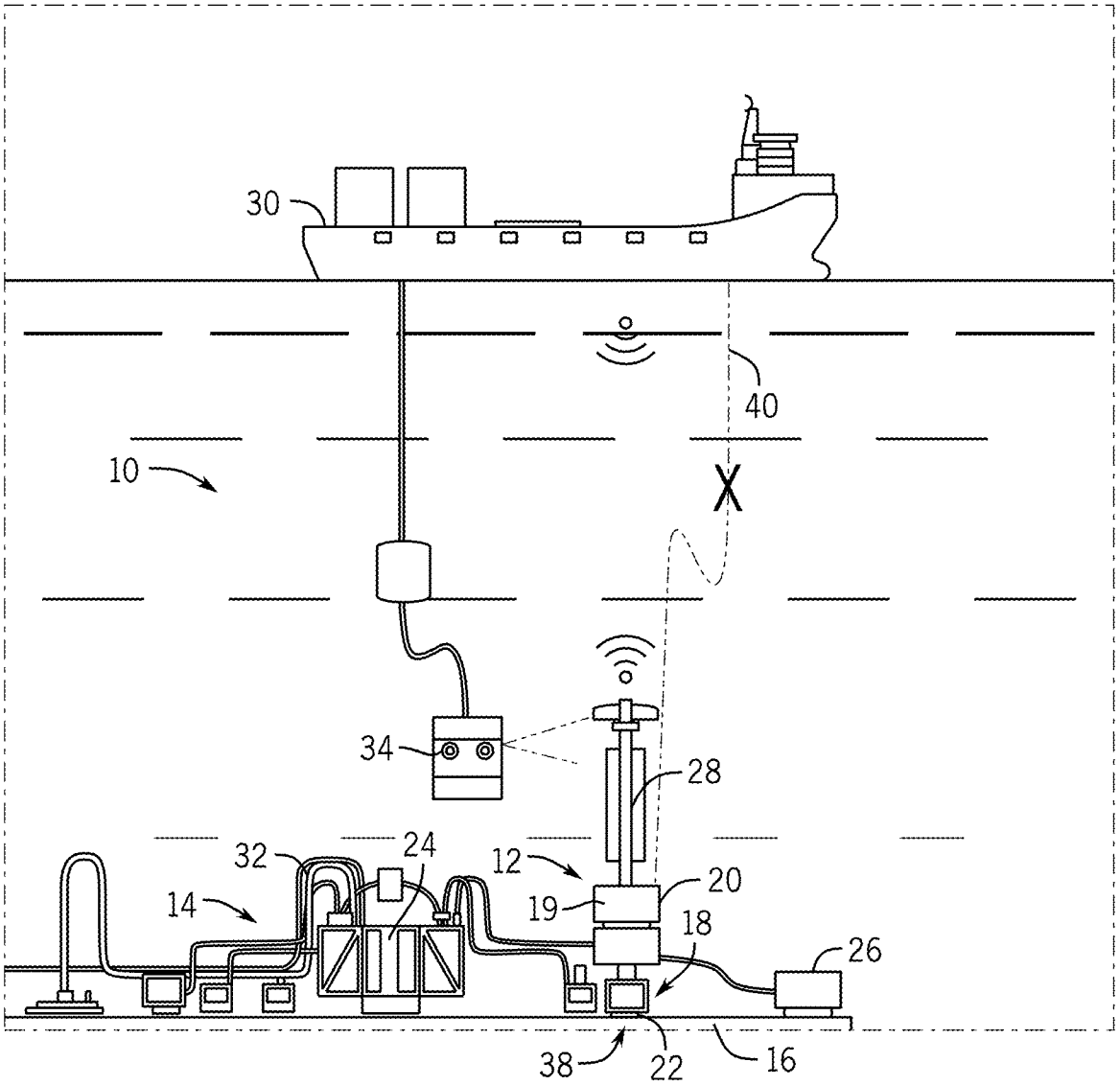
FIG. 1 is a schematic view of a subsea well intervention system having an autonomous robotic system, according to an embodiment of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection (e.g., where the connection may not include or include intermediate or intervening components between those coupled), and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment," "an embodiment," or "some embodiments" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Provided herein is a system and method for a well intervention system having autonomous robotic system deployed into a wellbore of a subsea well. The autonomous robotic system is initially housed in a docking system that is deployed to a subsea structure connected to the subsea well from a seaborne vessel. Although the docking system may initially be tethered to the vessel, the tether may be removed and the docking system may be left to deploy the autonomous robotic system into the wellbore and communicate with the autonomous robotic system. It may be appreciated that the operation of the docking system and the autonomous robotic system absent a tether to the vessel may enable the vessel to travel to a second location (e.g., to deploy an additional well intervention system) while the autonomous robotic system is operating within the wellbore. As discussed herein, the autonomous robotic system may perform a variety of well intervention tasks including setting or retrieving an isolation plug and/or a gas lift valve, repairing a downhole safety valve, cleaning wellbore corrosion, collecting production log data, or a combination thereof.

In view of the foregoing, FIG. 1 is a schematic view of a subsea well intervention system 10 having an autonomous robotic system 12. As used herein, the term "autonomous" refers to using a robot that is self-powered and/or self-propelled. The subsea well intervention system 10 may engage with a subsea system 14 disposed on a sea floor 16 for performing operations on a subsea well 18 of the subsea system 14. In the illustrated embodiment, the subsea system 14 includes subsea structures 19 disposed on the sea floor 16. For example, the subsea system 14 includes a tree 20 coupled to a wellhead 22 of the subsea well 18. The subsea system 14 also includes a manifold 24 and a power station 26. In the illustrated embodiment, the subsea well intervention system 10 includes a docking system 28 (e.g., carrier system, carrier module, cocoon, etc.), which is deployed from a vessel 30 (e.g., seaborne vessel) and guided to one of the subsea structures 19. In the illustrated embodiment, the docking system 28 is shown as being coupled to the tree 20 of the subsea system 14.

Although the illustrated embodiment shows the docking system 28 as coupling to the tree 20, it may be recognized that the docking system 28 may also be able to couple to the manifold 24, the power station 26, or another type of subsea structure 19. In certain embodiments, the docking system 28 may make electrical and/or hydraulic connections with the wellhead 22 and/or lines 32 of the subsea system 14. Additionally, the docking system 28 may remove and/or store an upper tree cap of the tree 20. As shown, a remotely operated vehicle (ROV) 34 may assist in guiding the docking system 28 to the subsea structure 19 prior to coupling (e.g., docking). In certain embodiments, the docking system 28 may be transported from the vessel 30 to the sea floor 16 in parts and may be assembled using one or more ROVs 34.

The docking system 28 houses at least one autonomous robotic system 12 (e.g., autonomous system, autonomous robot) for performing a subsea well intervention, as discussed in further detail herein. In certain embodiments, the autonomous robotic system 12 may include a self-powered and/or self-propelled mobile robot that moves axially through (e.g., in an axial direction of) a wellbore 38 of the subsea well 18. After the docking system 28 couples to the subsea structure 19, the autonomous robotic system 12 is deployed into the wellbore 38. In certain embodiments, the docking system 28 assists in the deployment of the autonomous robotic system 12. Additionally or alternatively, the autonomous robotic system 12 may assist in its own deployment from the docking system 28 into the wellbore 38. The docking system 28 may re-seal the top of the subsea well 18 after deployment of the autonomous robotic system 12 into the wellbore 38 of the subsea well 18.

As shown, the docking system 28 may communicate with the vessel 30. In certain embodiments, the docking system 28 may be tethered (e.g., electrically and/or hydraulically) to the vessel 30 via a tether 40 during at least a portion of the well intervention. In certain embodiments, the docking system 28 may communicate wirelessly to the vessel 30 without the tether 40. In certain embodiments, the docking system 28 may operate without communication with the vessel 30. In certain embodiments, the docking system 28 may communicate with a floating production storage and offloading (FPSO) station. It may be appreciated that the docking system 28 and the autonomous robotic system 12 may operate independently of the vessel 30, thereby enabling the vessel 30 to travel to another location to deploy a second docking system while the docking system 28 and autonomous robotic system 12 are performing operations on the subsea well 18.

Figure 2:
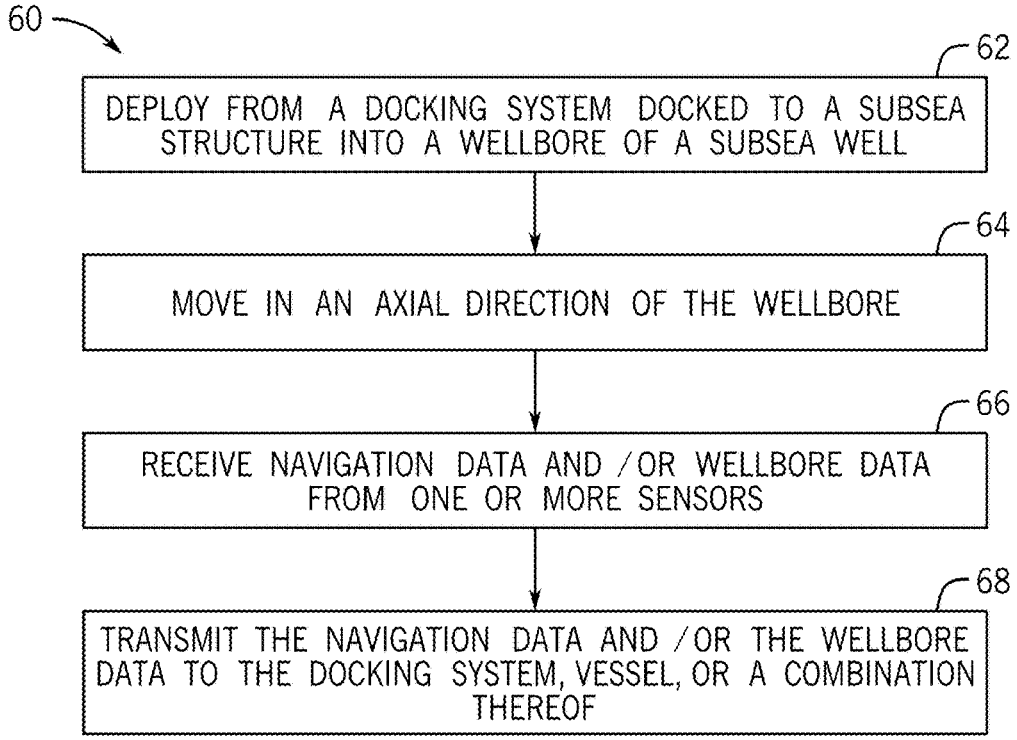
FIG. 2 is a flowchart of an example process of operating the autonomous robotic system of FIG. 1, according to an embodiment of the present disclosure.

FIG. 2 is a flowchart of an example process 60 of operating the autonomous robotic system 12. The process 60 may be performed by any other suitable computing device(s) or controller(s). Furthermore, the actions of the process 60 may be performed in the order disclosed herein or in any other suitable order. For example, certain actions of the process 60 may be performed concurrently. In addition, in certain embodiments, at least one of the actions of the process 60 may be omitted.

In block 62 of the process 60, the autonomous robotic system deploys from the docking system into the wellbore of a subsea well, the docking system being coupled (e.g., docked) to a subsea structure (e.g., tree) of the subsea well. In certain embodiments, a door (e.g., hatch) of the docking system may retract, thereby enabling passage of the autonomous robotic system into the wellbore. In other embodiments, the docking system may include one or more actuators that move the autonomous robotic system from a storage location to a starting position within the wellbore.

In block 64 of the process 60, the autonomous robotic system moves in an axial direction of the wellbore. For example, the autonomous robotic system may include a conveyance system that propels the autonomous robotic system through the wellbore. In certain embodiments, the conveyance system may include tracks that press against the interior surface of the wellbore, thereby stabilizing the autonomous robotic system. In certain embodiments, the conveyance system may include wheels and/or reciprocating grips. It may be recognized that the conveyance system may include one or more of a variety of mechanisms used for conveyance. Additionally or alternatively, at least a portion of the autonomous robotic system may move in a circumferential direction of the wellbore in order reach one or more objects disposed in wellbore and/or avoid obstacles.

In block 66 of the process 60, the autonomous robotic system receives navigation data and/or wellbore data from one or more sensors. As discussed herein, the autonomous robotic system may include one or more navigation sensors for navigating through the wellbore. For example, the one or more navigation sensors may provide navigation data at least partially indicative of a position of the autonomous robotic system within the wellbore relative to the docking system. Additionally or alternatively, the autonomous robotic system may include one or more wellbore sensors for sensing one or more parameters of the wellbore. For example, the wellbore sensors may be able to provide data indicative of a blockage, a defect, and/or a deterioration of the wellbore.

In block 68 of the process 60, the autonomous robotic system may transmit the navigation data and/or the wellbore data to the docking system and, in certain embodiments, the vessel. For example, the autonomous robotic system may communicate with the seaborne vessel, the docking system, or a combination thereof via wireless signals, acoustics, fluid pressure pulses, tethered electrical connection, tethered hydraulic connection, tethered fiber optic connection, or a combination thereof. In certain embodiments, the autonomous robotic system may transmit a portion of the received data to the docking system. For example, the autonomous robotic system may transmit the wellbore data to docking system, but retain the navigation data to be processed internally. In certain embodiments, the autonomous robotic system may store the wellbore data internally and transmit the wellbore data (e.g., to the seaborne vessel) after returning to the docking system.

Figure 3:
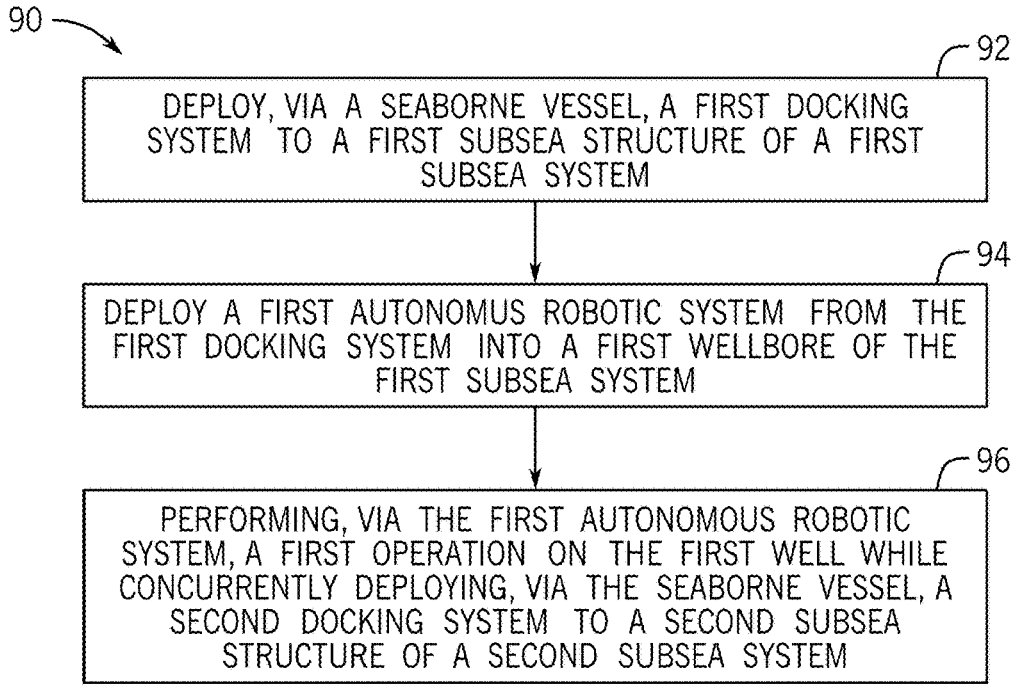
FIG. 3 is a flowchart of an example process of deploying multiple autonomous robotic systems, according to an embodiment of the present disclosure.

FIG. 3 is a flowchart of an example process 90 of deploying multiple autonomous robotic systems. The process 90 may be performed by any other suitable computing device(s) or controller(s). Furthermore, the actions of the process 90 may be performed in the order disclosed herein or in any other suitable order. For example, certain actions of the process 90 may be performed concurrently. In addition, in certain embodiments, at least one of the actions of the process 90 may be omitted.

In block 92 of the process 90, a seaborne vessel may deploy a first docking system to a first subsea structure of a first subsea system, the first subsea structure being coupled to a first subsea well. For example, the seaborne vessel may sail to a first nautical location located near the first subsea structure and remain stationary (e.g., anchor) at the first nautical location during the deployment of the first docking system. The first docking system may be lowered from the seaborne vessel and, in certain embodiments, guided by one or more ROVs. In response to coupling with (e.g., latching onto) the subsea structure, the docking system may form a seal with the subsea structure.

In block 94 of the process 90, a first autonomous robotic system is deployed from the first docking system into a first wellbore of the first subsea system. For example, the first autonomous robotic system may include a door (e.g., hatch) that opens after the docking system forms a seal with the subsea structure, thereby enabling the first autonomous robotic system to move from an interior of the docking system into the first wellbore.

In block 96 of the process 90, the first autonomous robotic system performs a first operation (e.g., intervention) on the first subsea well while the seaborne vessel concurrently moves to a second location and deploys a second docking system to a second subsea structure of a second subsea system. That is, while the first autonomous robotic system operates on the first subsea well, the vessel may deploy a second docking system carrying a second autonomous robotic system for operating on a second subsea well of the second subsea system. In certain embodiments, the first and second subsea systems may be the same subsea system. It may be appreciated that due to the docking systems and autonomous robot systems operating sans being tethered to the vessel, the vessel may be able to deploy multiple autonomous robotic systems while the autonomous robotic systems are operating on the subsea wells, thereby saving both time and money. In certain embodiments, the vessel may travel to more than one other location while the first autonomous robot system is operating on the first subsea well. For example, the vessel may travel to 2, 3, 4, 5, or more locations.

Figure 4:
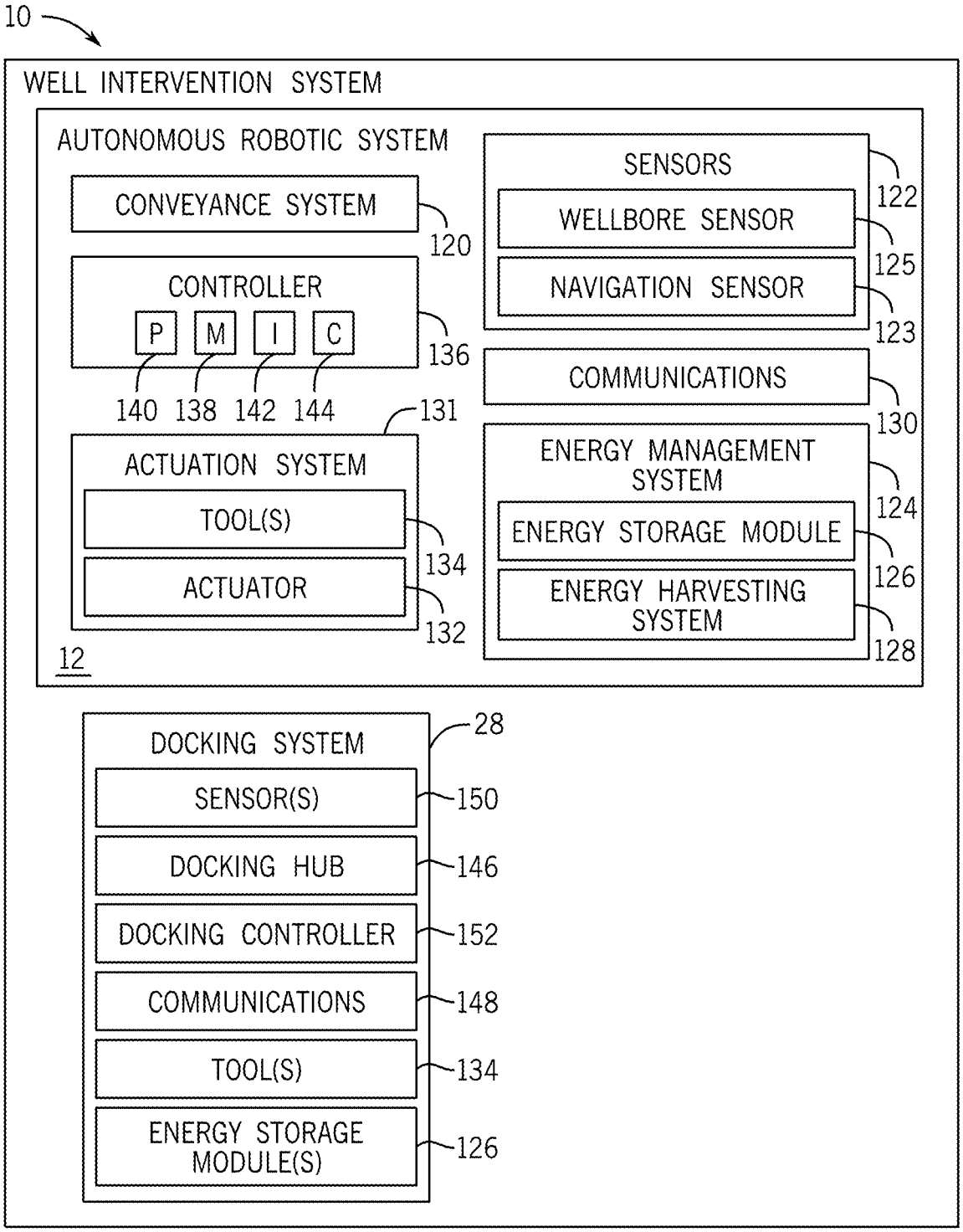
FIG. 4 is a diagrammatical view of the subsea well intervention system of FIG. 1 having the autonomous robotic system, according to an embodiment of the present disclosure.

FIG. 4 is a diagrammatical view of the subsea well intervention system 10 having the autonomous robotic system 12 and the docking system 28. As shown, the autonomous robotic system 12 includes a conveyance system 120 (e.g., locomotion system) that enables the autonomous robotic system 12 to move (e.g., axially translate) through the wellbore of the subsea well. It may be recognized that the wellbore of the subsea well may include a combination of vertical, slanted, curved, and horizontal portions. In certain embodiments, the conveyance system 120 may include one or more wheels, one or more tracks (e.g., continuous tracks), radially engaged grips, or a combination thereof. Additionally, the autonomous robotic system 12 includes one or more sensors 122. As discussed further herein, the one or more sensors 122 may include one or more navigation sensors 123 (e.g., tractor sensors), one or more wellbore sensors 125, or a combination thereof. In certain embodiments, the navigation sensors 123 may include a motor controller feedback sensor, a current sensor for determining a solenoid state, pressure sensors, linear potentiometers, wheel counter sensors (e.g., encoders), gyroscopes, accelerometers, gamma ray sensors, ultra-sonic sensors, casing collar locator (CCL) sensors, or a combination thereof.

The one or more navigation sensors 123 may provide data indicative of a navigation parameter of the autonomous robotic system 12. For example, the navigation parameter may include a position of the autonomous robotic system 12 in the wellbore 38 relative to the docking system 28. The one or more wellbore sensors 125 may provide data indicative of a wellbore parameter of the wellbore 38.

As shown, the autonomous robotic system 12 may also include an energy management system 124 that includes one or more energy storage modules 126 (e.g., batteries) and an energy harvesting system 128. It may be recognized that the autonomous robotic system 12 may use energy stored in the energy storage modules 126 to traverse the wellbore without being tethered to the docking system 28. In certain embodiments, the energy harvesting system 128 may include harvesting thermal energy, using a flow of surrounding fluid to spin a turbine, or a combination thereof. The harvested energy may be used to at least partially replenish the energy storage modules 126.

The autonomous robotic system 12 additionally includes a communications system 130. As discussed herein, the autonomous robotic system 12 may communicate with the vessel, the docking system 28, or both. The communication system 130 may use a combination of wireless signals, acoustics, fluid pressure pulses, mechanical pulses, tethered electrical connections, or tethered hydraulic connections. It may be appreciated that the communications system 130 may enable computations to be split between the autonomous robotic system 12 and the docking system 28 for redundancy and coordination.

As shown, the autonomous robotic system 12 also includes an actuation system 131 (e.g., intervention system) for interacting with the wellbore. The actuation system 131 may include an actuator 132 and, in certain embodiments, a tool 134. For example, the actuator 132 may include a linear actuator, a robotic manipulator, a tractor drive, or a combination thereof. In certain embodiments, the actuator 132 may be able to move the tool 134. The tool 134 may include a gas lift valve (GLV) management tool, a logging tool, a punching tool, and/or a plug management tool. In certain embodiments, the actuator 132 may change tools via a tool changing assembly. The tool changing assembly may be disposed in the docking system 28, on the autonomous robotic system 12, or a combination thereof. In certain embodiments, the autonomous robotic system 12 may include more than one actuator 132.

In the illustrated embodiment, the autonomous robotic system 12 also includes a controller 136 (e.g., downhole compute engine [DCE]) having a memory 138 and a processor 140 that executes instructions 142 stored in the memory 138 via circuitry 144. As discussed herein, the controller 136 is communicatively coupled to the conveyance system 120, the one or more sensors 122, the energy management system 124, the actuation system 131, or a combination thereof. For example, the controller 136 may receive data from the energy storage modules 126, the energy harvesting system 128, the actuation system 131, the navigation sensors 123, and/or the wellbore sensors 125. In certain embodiments, the controller 136 compares data collected from the sensors 122 with a master job plan and/or a wellbore navigation map. Additionally or alternatively, the controller 136 may send instructions directly to the actuator 132 and/or the tool 134 or, in certain embodiments, may send instructions to a subsystem (e.g., the actuation system 131) that then sends instructions to the actuator 132 and/or the tool 134. As discussed herein, the controller 136 may delegate one or more tasks with the docking system 28.

In the illustrated embodiment, the docking system 28 includes a docking hub 146, docking communications system 148, one or more docking sensors 150, and a docking controller 152 having a memory and a processor. The docking hub 146 may include one or more docking stations which may hold one or more autonomous robotic systems 12. In certain embodiments, the docking hub 146 may recharge the energy storage modules 126 of the autonomous robotic system 12 when the autonomous robotic system 12 is docked in the docking hub 146. The docking hub 146 may also include a housing that shields the autonomous robotic systems from the being exposed to seawater.

As shown, the docking system 28 also includes the docking communications system 148. The docking communications system 148 may communicate with the communication system 130 onboard the autonomous robotic system 12. The docking communications system 148 may communicate via a combination of wireless signals, acoustics, fluid pressure pulses, tethered electrical connections, or tethered hydraulic connections. It may be appreciated that the communications system 130 and the docking communication system 148 may enable computations to be split between the autonomous robotic system 12 and the docking system 28 for redundancy and coordination.

Additionally, the docking system 28 includes the one or more docking sensors 150. In certain embodiments, the one or more docking sensors 150 may provide data indicative of one or more objects in proximity to the docking system 28. For example, the one or more docking sensors 150 may provide a signal in response to the docking system 28 nearing the subsea structure during the initial deployment of the docking system. Additionally or alternatively, the one or more docking sensors 150 may provide a signal indicative of the autonomous robotic system 12 nearing the docking system 28 when returning from an intervention operation in the wellbore.

The docking system 28 also includes the docking controller 152, which may be communicatively coupled to the docking hub 146, the docking communications system 148, the one or more docking sensors 150, or a combination thereof. For example, the docking controller 152 may receive data (e.g., position of the autonomous robotic system 12) from the docking communications system 148 and perform one or more calculations on the received data. Additionally or alternatively, the docking controller 152 may receive data from the one or more docking sensors 150 and perform an operation based on the received data. For example, the docking controller 152 may instruct the docking hub 146 to form a seal with the wellbore in response to the one or more docking sensors 150 providing data indicative of a coupling of the docking system 28 with the wellbore. In certain embodiments, the docking system 28 may house intervention tools such as new GLV or isolation plugs. Additionally or alternatively, the docking system 28 may house replacement energy storage modules (e.g., batteries) and/or an energy storage module recharge station.

Figure 5:
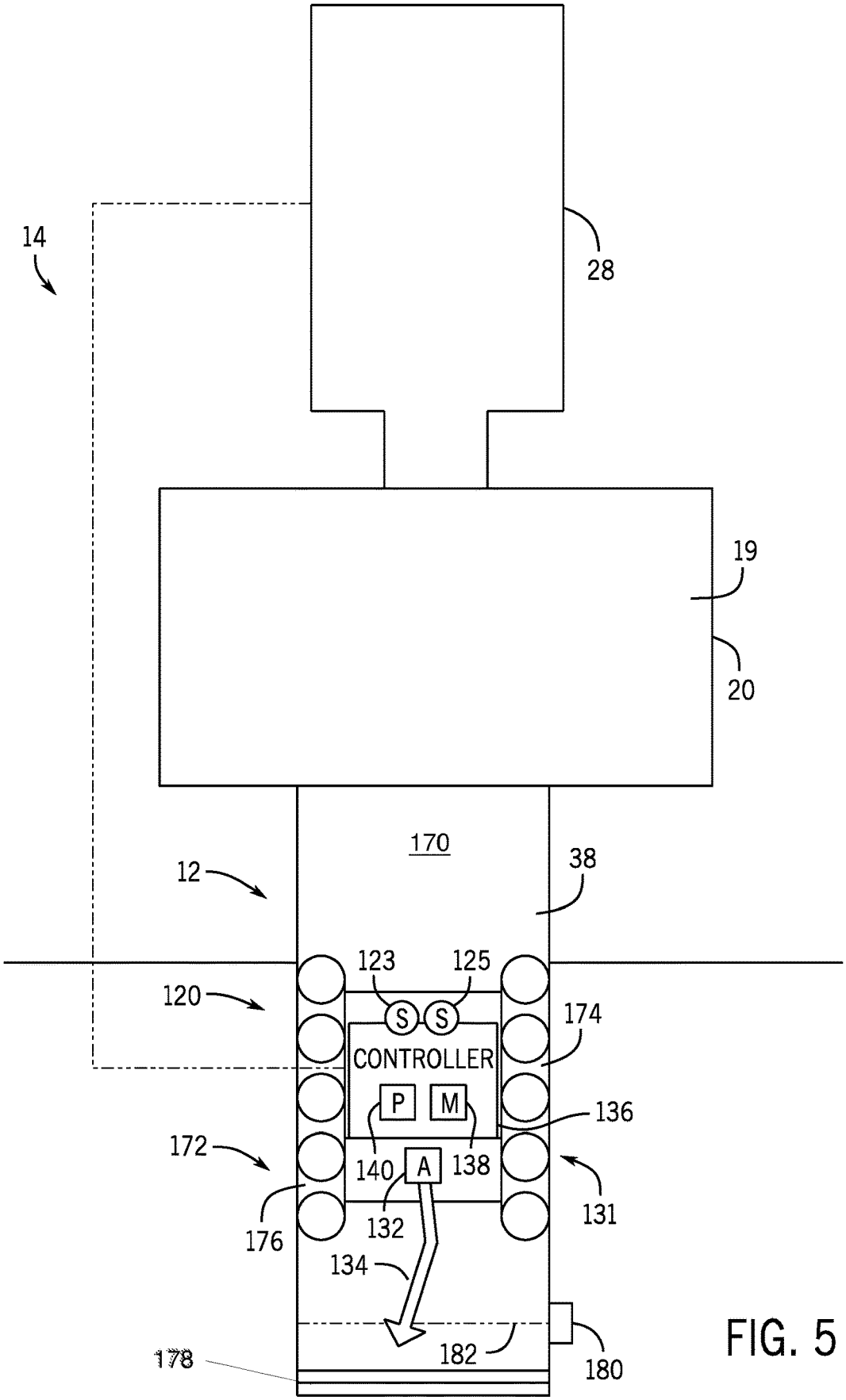
FIG. 5 is a schematic view of the autonomous robotic system of FIG. 1 performing a subsea well intervention, according to an embodiment of the present disclosure.

FIG. 5 is a schematic view of the autonomous robotic system 12 performing a subsea well intervention. In the illustrated embodiment, the docking system 28 is coupled to the subsea structure 19 (e.g., tree 20) of the subsea system 14. As shown, the subsea structure 19 provides access to the wellbore 38 disposed in the seafloor 16. As shown, the autonomous robotic system 12 is traveling (e.g., axially moving), via the conveyance system 120, through the interior 170 of the wellbore 38. As shown, the conveyance system 120 of the autonomous robotic system 12 includes continuous tracks 172 (e.g., continuous tracks 174, 176), though it may be recognized that the conveyance system 120 may include another mode of locomotion. For example, the conveyance system 120 may include a wheeled tractor system, a reciprocating tractor system, or a combination thereof. In the illustrated embodiment, the wellbore 38 includes an isolation plug 178 and a gas lift valve 180, though in certain embodiments the wellbore 38 may include additional types of adjustors.

In the illustrated embodiment, the autonomous robotic system 12 includes the one or more navigation sensors 123 and the one or more wellbore sensors 125. Additionally, as shown, the autonomous robotic system 12 includes the actuation system 131 having the actuator 132 and the tool 134. The actuator 132 may actuate the tool 134 to service the wellbore 38. For example, servicing the wellbore 38 may include adjusting the isolation plug 178, adjusting the gas lift valve 180, or a combination thereof. It may be recognized that servicing the wellbore 38 may include additional services performed on the wellbore 38.

As shown, the autonomous robotic system 12 also includes the controller 136. The controller 136 may receive navigation data provided by the one or more navigation sensors 123. Additionally, the controller 136 may determine a navigation parameter based on the received navigation data. In certain embodiments, the navigation parameter may include a position, velocity, acceleration, or a combination thereof of the autonomous robotic system 12 within the wellbore 38. Additionally, the controller 136 may instruct the actuator 132 based on the determined navigation parameter. For example, the controller 136 may instruct the actuator 132 to move to adjust the isolation plug 178 in response to the autonomous robotic system 12 reaching a certain position within the wellbore 38.

Additionally or alternatively, the controller 136 may receive wellbore data provided by the one or more wellbore sensors 125. Additionally, the controller 136 may determine a wellbore parameter based on the received navigation data. In certain embodiments, the wellbore parameter may include a location and/or status of the isolation plug, the gas lift valve 180, or a combination thereof. In certain embodiments, the wellbore parameter may include defects or blockage within the wellbore 38. Additionally, the controller 136 may instruct the actuator 132 based on the determined wellbore parameter. For example, the controller 136 may instruct the actuator 132 to move adjust the isolation plug 178 in response to controller 136 determining the isolation plug to be in a certain position or orientation.

Additionally, the controller 136 may store a wellbore intervention plan in the memory 138 of the controller 136. In certain embodiments, the wellbore intervention plan may include a series of steps to be executed by the autonomous robotic system 12 to accomplish a task. For example, the wellbore intervention plan may include a first step instructing the autonomous robotic system 12 to descend to a depth 182 in the wellbore 38, a second step with instructions to perform a certain action upon reaching the depth 182, and a third step to return to the docking system 28. In certain embodiments, the wellbore intervention plan may include conditional and/or iterative steps. For example, the autonomous robotic system 12 may perform a certain action in response to wellbore data received from the one or more wellbore sensors 125 meeting one or more criteria. In certain embodiments, the controller 136 may execute the wellbore intervention plan while communicating with the docking system 28, but without communication to the seaborne vessel.

Figure 6:
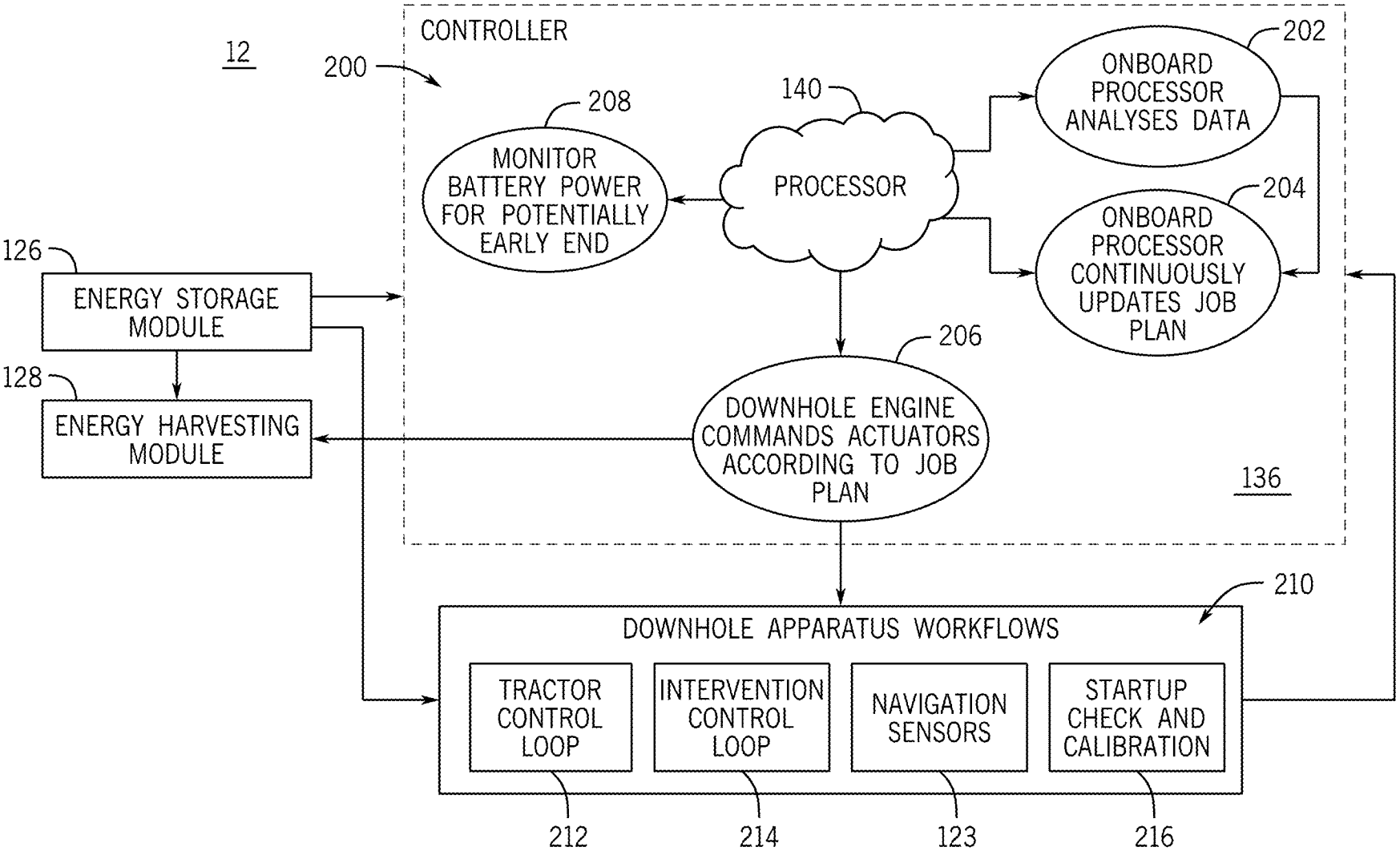
FIG. 6 is a schematic view of a workflow of the controller of the autonomous robotic system of FIG. 1, according to an embodiment of the present disclosure.

FIG. 6 is a schematic view of a workflow of the controller 136 (e.g., downhole compute engine) of the autonomous robotic system 12. As shown, the controller 136 includes the processor 140 (e.g., downhole compute engine processor) that performs tasks 200 (e.g., tasks 202, 204, 206, and 208). Task 202 includes analyzing data received from the one or more navigation sensors 123 and, in certain embodiments, the one or more wellbore sensors. For example, the task 202 may include determining a moving average, removing outliers, and/or other data analyses. Task 204 includes continuously updating the job plan based at least partially on the analysis of the received data from the one or more navigation sensors 123. In certain embodiments, task 204 may include updating a state of the autonomous robotic system 12 using a filter (e.g., Kalman filter, extended Kalman filter) or another form of fusion of sensor data. In certain embodiments, the controller 136 will continuously review the received data and compare the data against a master job plan, the wellbore navigation map, or a combination thereof. Task 206 includes commanding actuators according to the well intervention plan (e.g., job plan) stored in the memory, as discussed in further detail herein. Task 208 includes monitoring the power stored in the energy storage modules 126 (e.g., batteries) and ending the well intervention plan early if the energy remaining in the energy storage modules 126 is insufficient for completing the well intervention plan.

As shown, the controller 136 sends and receives data from the apparatus workflows 210, as performed in task 206. The apparatus workflows 210 include a tractor control loop 212, an intervention control loop 214, the one or more navigation sensors 123, and a startup procedure 216. For example, the controller 136 may send a setpoint (e.g., reference) motor state (e.g., position, velocity, acceleration, etc.) to the tractor control loop 212. Additionally or alternatively, the controller 136 may send a setpoint (e.g., reference) actuator state to one or more actuators. In certain embodiments, the controller 136 may activate and/or deactivate the navigation sensors 123 based on one or more parameters (e.g., location of the autonomous robotic system 12). Additionally or alternatively, the controller 136 may initiate the startup procedure 216 prior to deployment of the autonomous robotic system 12 into the wellbore. Additionally or alternatively, the controller 136 may receive data from the one or more navigation sensors 123. In certain embodiments, the controller 136 may use programmed logic, machine learning (e.g., iteratively trained via onboard sensors), or a combination thereof to continuously send the next series of commands to the apparatus workflows 210.

As shown, the energy storage modules 126 may send data to the controller 136 indicative of an amount of energy remaining in the energy storage modules 126. Additionally, the energy storage modules 126 send energy to the apparatus workflows 210. For example, the energy storage modules 126 may power the conveyance system (e.g., motors), the actuators, the navigation sensors 123, and additional apparatuses of the autonomous robotic system 12. Additionally, as shown, the energy storage modules 126 may send energy to the energy harvesting system 128 and, in certain embodiments, receive harvested energy from the energy harvesting system 128.

Figure 7:
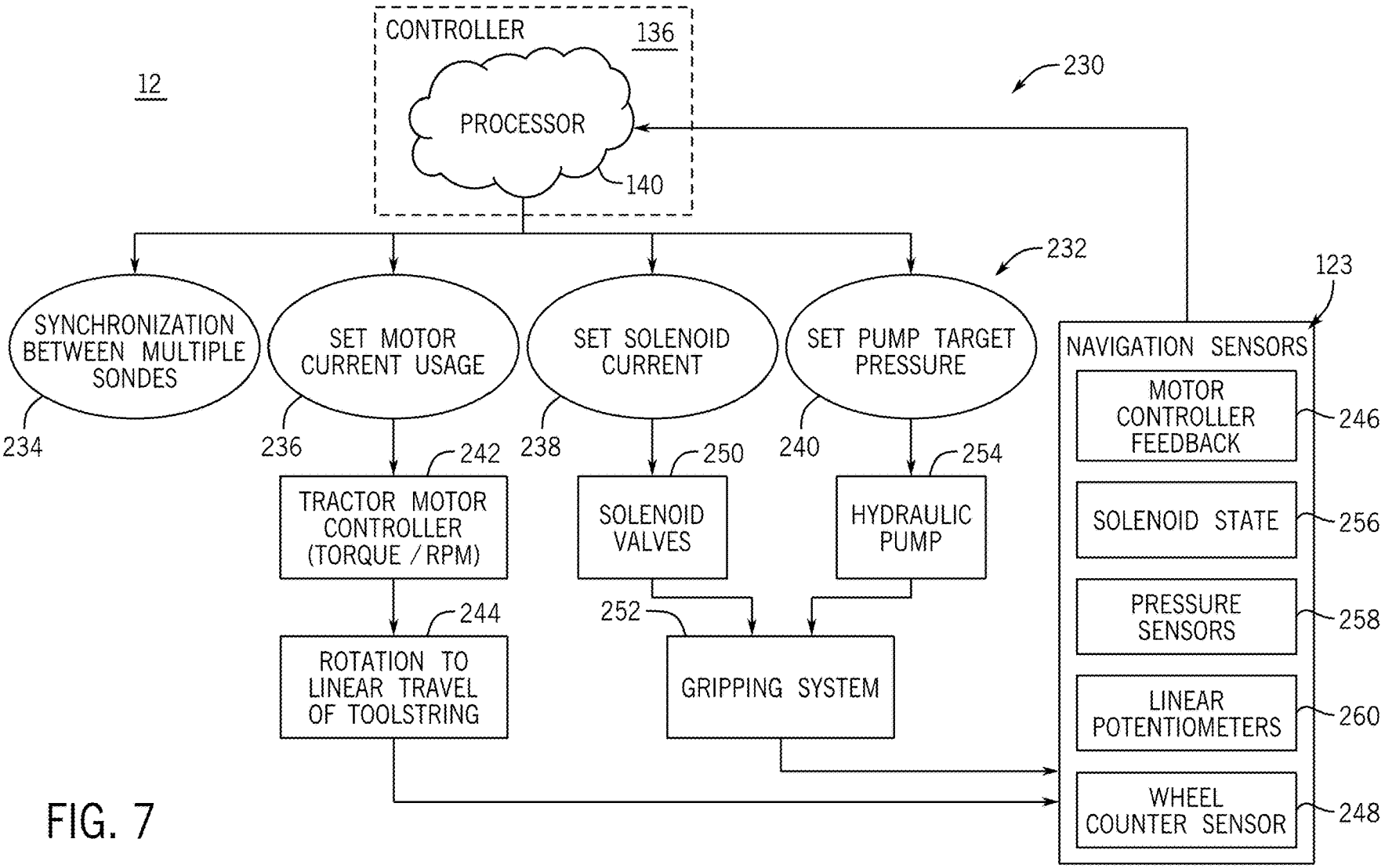
FIG. 7 is a schematic view of a control loop of a conveyance system of the autonomous robotic system of FIG. 1, according to an embodiment of the present disclosure.

FIG. 7 is a schematic view of a conveyance control loop 230 of the conveyance system of the autonomous robotic system 12. As shown, the conveyance control loop 230 includes the controller 136 performing conveyance tasks 232 (e.g., conveyance tasks 234, 236, 238, and 240) of the conveyance control loop 230, and receiving data from the navigation sensors 123 (e.g., tractor sensors). The conveyance task 234 is synchronization between multiple sondes (e.g., sensors). For example, the one or more sondes may be disposed within the wellbore and may collect data (e.g., spatial data) indicative of one or more parameters (e.g., spatial parameters) of the wellbore. The conveyance task 236 includes setting a motor current usage of a motor of the conveyance system 120. The motor current may be sent to a tractor motor controller 242 (e.g., tractor control loop) as an input. In certain embodiments, the tractor motor controller 242 outputs a motor torque, a motor velocity, or a combination thereof to the motor of the conveyance system 120. In certain embodiments, the tractor motor controller 242 may take motor velocity and/or motor position as an input and may output a motor current, a motor voltage, or a combination thereof. As shown, block 244 includes the conversion of the rotation of the motor to linear motion, which may be performed by the controller 136. The navigation sensors 123 may include motor controller feedback 246, a wheel counter sensor 248 (e.g., encoder), or a combination thereof which may provide feedback to the controller 136 corresponding to the tractor motor controller 242.

As shown, the controller 136 may perform the task 238, which includes setting a solenoid current of one or more solenoid valves 250 of a gripping system 252. Additionally or alternatively, the controller 136 may perform the task 240, which includes setting a target pressure of one or more hydraulic pumps 254 of the gripping system 252. By performing the task 238 and/or the task 240, the controller 136 may control the gripping system 252 during movement of the autonomous robotic system 12 (e.g., moving long distances) and/or during interventions that may employ the gripping system 252. As shown, the gripping system 252 may be equipped with one or more sensors 122, including a solenoid state sensor 256, pressure sensors 258, and/or linear potentiometers 260, which may provide feedback to the controller 136 regarding the state of the gripping system 252. In certain embodiments, the controller 136 may perform the tasks 232 to control the direction and/or speed of travel of the autonomous robotic system 12 and/or the gripping system 252.

Figure 8:
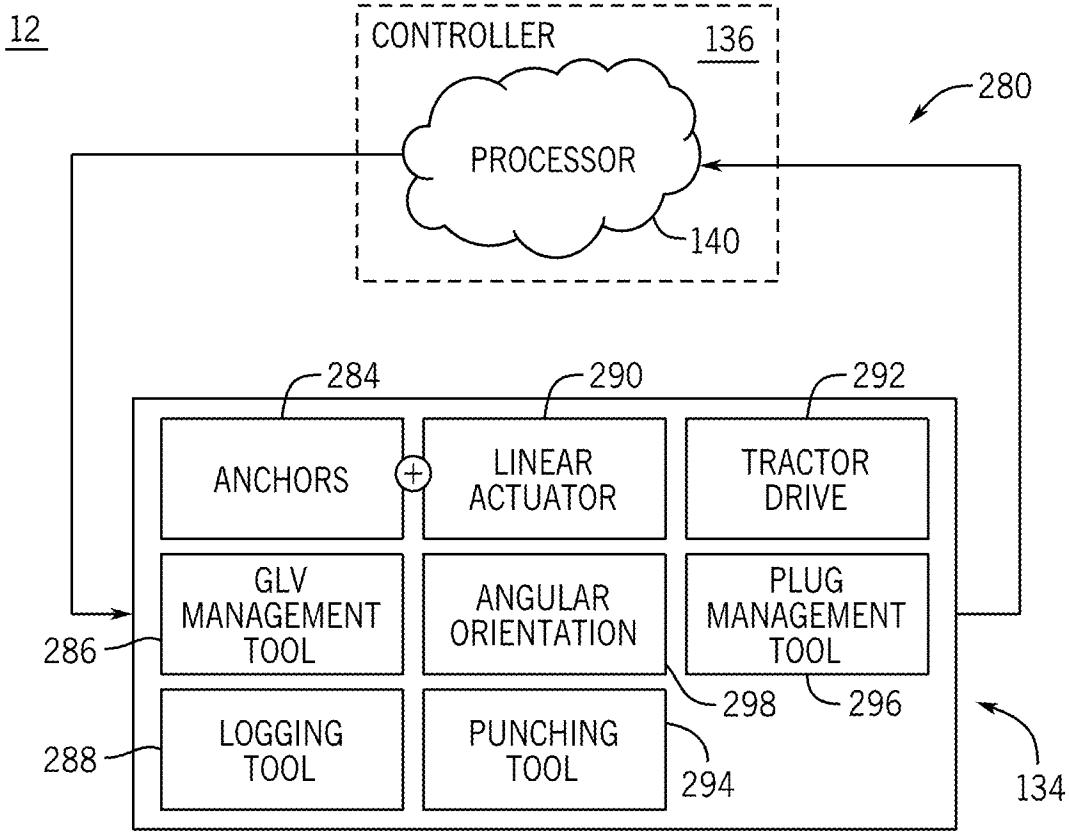
FIG. 8 is a schematic view of a control loop of an intervention system of the autonomous robotic system of FIG. 1, according to an embodiment of the present disclosure.

FIG. 8 is a schematic view of an intervention control loop 280 of an intervention actuation system (e.g., intervention tool package) of the autonomous robotic system 12. As shown, the intervention actuation system may include one or more tools 134 (e.g., actuators), including an anchor 284, a GLV management tool 286, a logging tool 288, a linear actuator 290, a tractor drive 292 (e.g., motor), a punching tool 294, a plug management tool 296, angular orientation hardware 298, and/or other intervention tools. As shown, the controller 136 may send control commands to the one or more tools 134 and also receive feedback from one or more sensors accompanying the one or more tools 134.

In certain embodiments, the intervention control loop 280 may include control of the conveyance system, the anchor 284, and/or the linear actuator 290 to manage a movement of the one or more tools 134 during an intervention. For example, the controller 136 may send commands to different tools 134 of specific intervention packages corresponding to different types of services on the wellbore. In certain embodiments, the intervention packages may include setting and/or retrieving an isolation plug (e.g., via the plug management tool 296), a tubing puncher module (e.g., via the punching tool 294), a tubing gauge/scraper module (e.g., via the tractor drive 292 and/or the linear actuator 290), a logging module (e.g., via the logging tool 288), and a module for removing and installing gas lift valves (e.g., via the angular orientation hardware 298).

Figure 9:
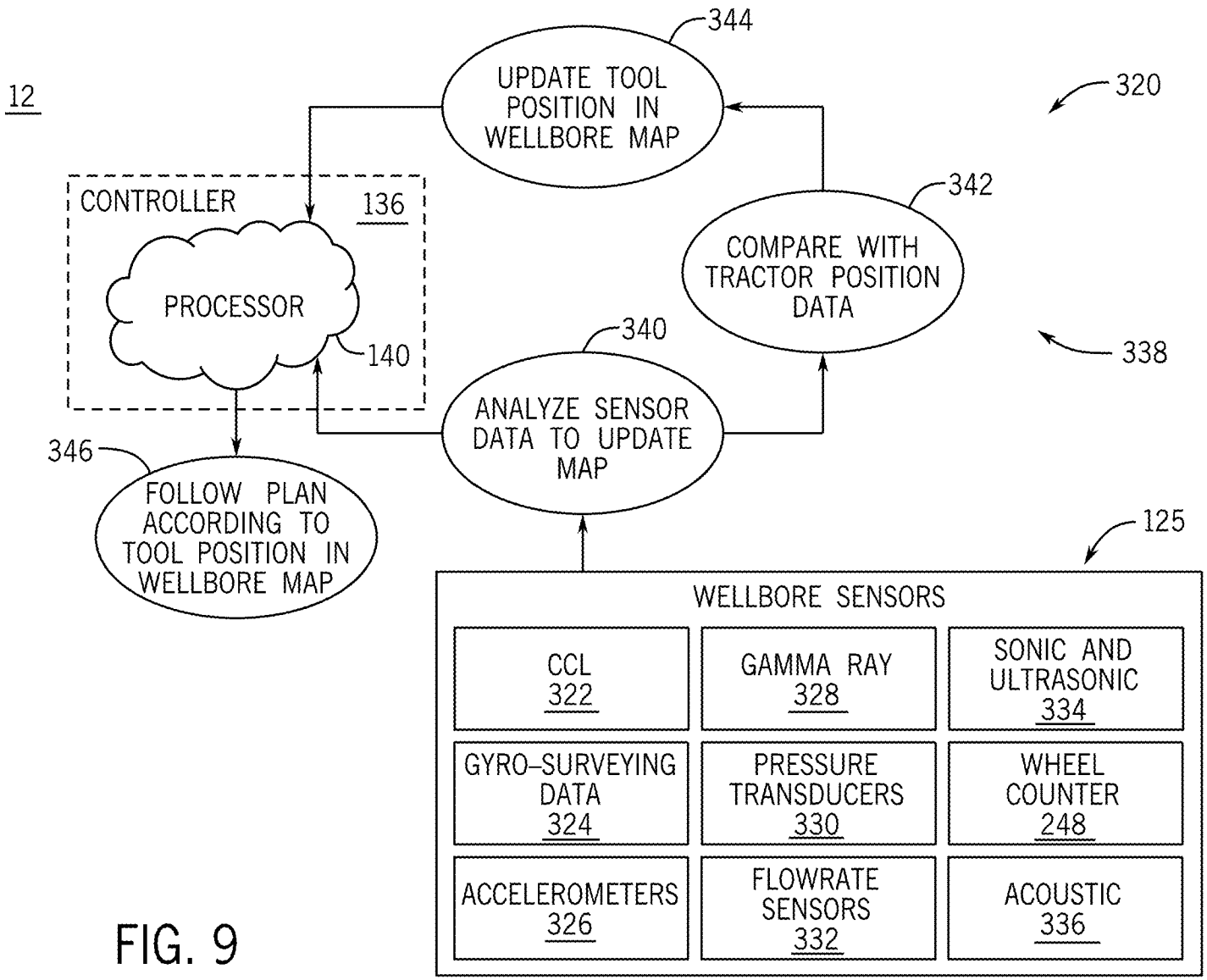
FIG. 9 is a schematic view of a navigation system of the autonomous robotic system of FIG. 1, according to an embodiment of the present disclosure.

FIG. 9 is a schematic view of a navigation system 320 of the autonomous robotic system. As shown, the autonomous robotic system includes wellbore sensors 125 (e.g., onboard sensors) used for navigating the autonomous robotic system within the wellbore. The wellbore sensors 125 may be coupled to a toolstring disposed in the wellbore and may also be electrically coupled to the controller 136 (e.g., processor, downhole compute engine). In certain embodiments, the wellbore sensors 125 may feed data indicative of a downhole environment of the wellbore to the controller 136. As shown, the wellbore sensors 125 may include a casing collar locator (CCL) 322, a gyroscope 324, an accelerometer 326, a gamma ray sensor 328, a pressure transducer 330, a flowrate sensor 332, a sonic/ultra-sonic sensor 334, the wheel counter sensor 248, an acoustic sensor 336, or a combination thereof.

As shown, the controller 136 may perform navigation tasks 338 (e.g., navigation tasks 340, 342, 344, and 346) for estimating the state (e.g., position, velocity, acceleration, orientation, etc.) of the autonomous robot system and, in certain embodiments, a toolstring coupled to the autonomous robot system within the wellbore. In the task 340, the controller 136 analyzes data collected from the navigation sensors 123 and compares the data against a map of the wellbore stored in the memory of the controller 136 to update the map. In the task 342, the controller 136 compares the updated map with position data of the tractor (e.g., toolstring). In the task 344, the controller updates the state (e.g., position, velocity, acceleration, etc.) of the tool in the wellbore map. In the task 346, the controller 136 follows the plan (e.g., trajectory, path, etc.) according to the tool position in the wellbore map. In certain embodiments, the controller 136 may use a filtering and/or sensor fusion technique (e.g., Kalman filter, extended Kalman filter, particle filter, etc.) to update the wellbore map in addition to one or more linear and/or nonlinear control techniques used for the toolstring and/or the actuators.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principles of the disclosure and its practical applications, to thereby enable others skilled in the art to best utilize the disclosure and various embodiments with various modifications as are suited to the particular use contemplated.

Finally, the techniques presented and claimed herein are referenced and applied to material objects and concrete examples of a practical nature that demonstrably improve the present technical field and, as such, are not abstract, intangible or purely theoretical.

The invention claimed is:

1. A system, comprising:

an autonomous robotic system, comprising:

a well intervention system configured to service a wellbore of a subsea well of a subsea system, the well intervention system comprising:

a tool; and a robotic manipulator configured to move the tool; and a navigation sensor configured to provide navigation data indicative of a navigation parameter associated with the autonomous robotic system; and a docking system deployed by a seaborne vessel, the docking system configured to:

house the autonomous robotic system; and couple to a subsea structure of the subsea system, the subsea structure disposed on a sea floor;

wherein the autonomous robotic system is configured to:

deploy from the docking system into the wellbore;

move within the wellbore; and control the robotic manipulator based on the navigation data.

2. The system of claim 1, wherein the autonomous robotic system is a mobile robot configured to move through the wellbore in an axial direction of the wellbore, wherein the mobile robot is self-powered and self-propelled.

3. The system of claim 1, wherein the autonomous robotic system is configured to communicate with the seaborne vessel, the docking system, or a combination thereof via wireless signals, acoustics, fluid pressure pulses, tethered electrical connection, tethered hydraulic connection, or a combination thereof.

4. The system of claim 1, comprising a controller having a memory and a processor, the controller configured to:

receive the navigation data provided by the navigation sensor; and determine the navigation parameter based on the navigation data.

5. The system of claim 4, wherein the navigation parameter is indicative of a position of the autonomous robotic system within the wellbore relative to the docking system.

6. The system of claim 4, wherein servicing the wellbore comprises:

adjusting an isolation plug;

setting, retrieving, or adjusting a gas lift valve;

repairing a downhole safety valve;

cleaning the wellbore of corrosion;

retrieving wellbore production logging data; or a combination thereof.

7. The system of claim 4, wherein the controller is configured to:

store a wellbore intervention plan on the memory; and execute the wellbore intervention plan without communication with the seaborne vessel.

8. The system of claim 4, wherein the navigation sensor comprises a pressure sensor, a current sensor, a linear potentiometer, a wheel counter, a casing collar locator, an accelerometer, or a combination thereof.

9. The system of claim 4, wherein the autonomous robotic system comprises a wellbore sensor configured to provide wellbore data indicative of a wellbore parameter.

10. The system of claim 9, wherein the controller is configured to:

receive the wellbore data from the wellbore sensor;

determine the wellbore parameter based on the wellbore data; and transmit the wellbore data to the seaborne vessel.

11. The system of claim 4, wherein the controller is configured to control the robotic manipulator to adjust an isolation plug disposed in the wellbore based on the navigation parameter.

12. The system of claim 1, wherein the autonomous robotic system comprises an energy storage module, wherein the autonomous robotic system is configured to:

harvest energy; and at least partially replenish the energy storage module with the harvested energy.

13. The system of claim 1, wherein the autonomous robotic system comprises:

a wellbore sensor configured to provide wellbore data indicative of a wellbore parameter; and a controller having a memory and a processor, the controller configured to:

receive the navigation data provided by the navigation sensor;

determine the navigation parameter based on the navigation data;

control the robotic manipulator based on the navigation parameter;

store a wellbore intervention plan on the memory;

execute the wellbore intervention plan without communication with the seaborne vessel;

receive the wellbore data from the wellbore sensor;

determine the wellbore parameter based on the wellbore data; and transmit the wellbore data to the seaborne vessel.

14. A system, comprising:

an autonomous robotic system, comprising:

a well intervention system configured to service a wellbore of a subsea well of a subsea system, the well intervention system comprising:

a tool; and a robotic manipulator configured to move the tool; and a navigation sensor configured to provide navigation data indicative of a navigation parameter associated with the autonomous robotic system;

wherein the autonomous robotic system is configured to:

deploy from a docking system into the wellbore, wherein the docking system is deployed from a surface and coupled to a subsea structure of the subsea system, and wherein the wellbore is disposed in a sea floor;

move within the wellbore; and control the robotic manipulator based on the navigation data.

15. The system of claim 14, wherein the autonomous robotic system is a mobile robot configured to move through the wellbore in an axial direction of the wellbore, wherein the mobile robot is self-powered and self-propelled.

16. The system of claim 14, comprising a controller having a memory and a processor, the controller configured to:

receive the navigation data provided by the navigation sensor; and determine the navigation parameter based on the navigation data.

17. The system of claim 16, wherein the autonomous robotic system comprises a wellbore sensor configured to provide wellbore data indicative of a wellbore parameter.

18. The system of claim 17, wherein the controller is configured to:

receive the wellbore data from the wellbore sensor; and determine the wellbore parameter based on the wellbore data.

19. A method, comprising:

deploying, via a seaborne vessel, a docking system to a subsea structure of a subsea system;

deploying an autonomous robotic system from the docking system into a wellbore of the subsea system, wherein the autonomous robotic system comprises:

a well intervention system configured to service the wellbore of a subsea well of the subsea system, the well intervention system comprising:

a tool; and a robotic manipulator configured to move the tool; and a navigation sensor configured to provide navigation data indicative of a navigation parameter associated with the autonomous robotic system;

deploying the tool housed in the autonomous robotic system; and controlling the robotic manipulator to perform an operation on the wellbore with the tool based on the navigation data.

20. The method of claim 19, comprising:

receiving, via a controller, wellbore data from a wellbore sensor of the autonomous robotic system; and determining, via the controller, a wellbore parameter based on the wellbore data.

* * * * *